US008346121B2

(12) United States Patent
Okamoto

(10) Patent No.: US 8,346,121 B2
(45) Date of Patent: Jan. 1, 2013

(54) IMAGE FORMING APPARATUS AND IMAGE FORMING STRUCTURE

(75) Inventor: Masaya Okamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 490 days.

(21) Appl. No.: 12/622,795

(22) Filed: Nov. 20, 2009

(65) Prior Publication Data

US 2010/0232828 A1 Sep. 16, 2010

(30) Foreign Application Priority Data

Mar. 10, 2009 (JP) ..... 2009-056090

(51) Int. Cl.
*G03G 15/00* (2006.01)
*G03G 15/08* (2006.01)
*G03G 21/16* (2006.01)

(52) U.S. Cl. ..... 399/110; 399/111; 399/262
(58) Field of Classification Search ..... 399/110, 399/111, 262
See application file for complete search history.

(56) References Cited

U.S. PATENT DOCUMENTS

| | | | | |
|---|---|---|---|---|
| 5,878,309 | A * | 3/1999 | Nomura et al. | 399/111 |
| 6,154,623 | A | 11/2000 | Suzuki et al. | |
| 6,668,145 | B2 * | 12/2003 | Wang et al. | 399/258 |
| 2004/0258432 | A1 * | 12/2004 | Hatori et al. | 399/111 |
| 2005/0008395 | A1 * | 1/2005 | Yamaguchi et al. | 399/119 |
| 2006/0193655 | A1 | 8/2006 | Hatori et al. | 399/111 |
| 2008/0170888 | A1 * | 7/2008 | Eto et al. | 399/263 |
| 2008/0175629 | A1 | 7/2008 | Eto et al. | 399/262 |

FOREIGN PATENT DOCUMENTS

| | | |
|---|---|---|
| JP | 10-149080 | 6/1998 |
| JP | 2004-361749 | 12/2004 |
| JP | 2008-090121 | 4/2008 |
| JP | 2008-203830 | 9/2008 |

* cited by examiner

*Primary Examiner* — Walter L Lindsay, Jr.
*Assistant Examiner* — David Bolduc
(74) *Attorney, Agent, or Firm* — Morgan, Lewis & Bockius LLP

(57) ABSTRACT

An image forming apparatus includes: an image forming apparatus main body; and an image forming structure attached to and removed from the image forming apparatus main body. In a state where the image forming structure is attached in the image forming apparatus main body, a concave part is formed in a position opposite to another concave part formed in an adjacent image forming structure.

11 Claims, 9 Drawing Sheets

IMAGE FORMING APPARATUS AND IMAGE FORMING STRUCTURE

CROSS-REFERENCE TO RELATED APPLICATIONS

This application is based on and claims priority under 35 USC 119 from Japanese Patent Application No. 2009-056090 filed Mar. 10, 2009.

BACKGROUND

TECHNICAL FIELD

The present invention relates to an image forming apparatus and an image forming structure.

SUMMARY

According to an aspect of the present invention, there is provided an image forming apparatus including: an image forming apparatus main body; and an image forming structure attached/removed in/from the image forming apparatus main body, in a state where the image forming structure is attached in the image forming apparatus main body, a concave part being formed in a position opposite to another concave part formed in an adjacent image forming structure.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
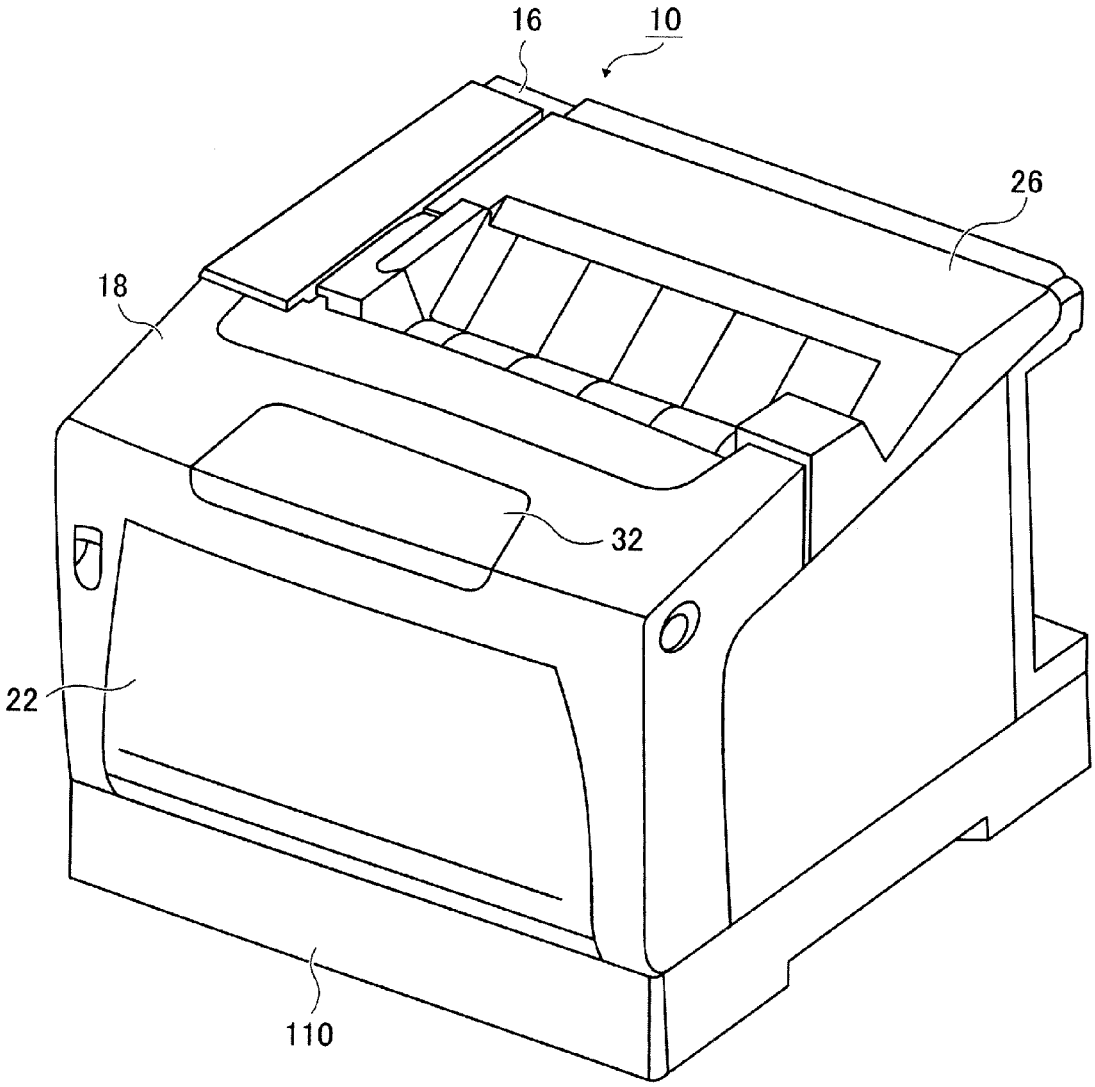
FIG. 1 is a perspective diagram showing an image forming apparatus according to an exemplary embodiment of the present invention.
Figure 2:
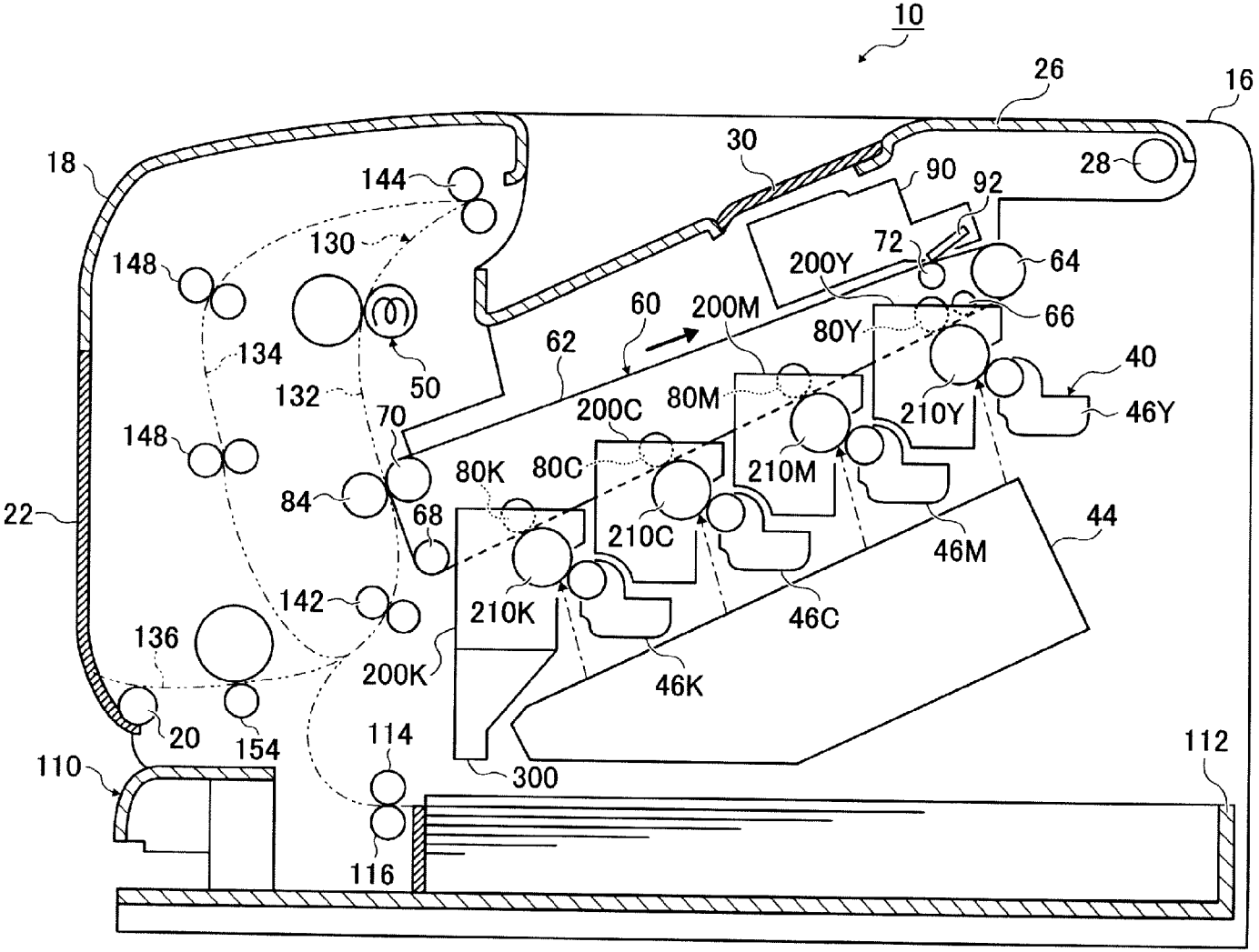
FIG. 2 is a cross-sectional diagram showing the image forming apparatus shown in FIG. 1 viewed from a right side surface.

FIGS. 1 and 2 show an image forming apparatus 10 according to a first exemplary embodiment of the present invention.

As shown in FIGS. 1 and 2, the image forming apparatus 10 has an image forming apparatus main body 16.

A front opening/closing part 18 is attached to the image forming apparatus main body 16 using a hinge 20 openably/closably with respect to the image forming apparatus main body 16. Further, a main opening/closing part 26 is attached to the image forming apparatus main body 16 using a hinge 28 openably/closably with respect to the image forming apparatus main body 16. Further, an operation part 32 is attached to a front side of the image forming apparatus main body 16.

A supply opening/closing part 22 is openably/closably attached to the front opening/closing part 18. As shown in FIGS. 1 and 2, the supply opening/closing part 22 is usually closed with respect to the front opening/closing part 18. When a sheet different from a sheet contained in a sheet supply device 110 to be described later is used, the supply opening/closing part 22 is opened with respect to the front opening/closing part 18.

The main opening/closing part 26 is usually closed with respect to the image forming apparatus main body 16. When one of photoreceptor units 200Y, 200M, 200C and 200B to be described later, is attached/removed in/from the image forming apparatus main body 16, the main opening/closing part 26 is opened. The front opening/closing part 18 is opened with respect to the image forming apparatus main body 16 prior to opening of the main opening/closing part 26 so as to prevent a support roller 70, an intermediate transfer belt 62 to be described later and the like attached to the main opening/closing part 26, from interfering with the front opening/closing part 18.

When the front opening/closing part 18 is closed with respect to the image forming apparatus main body 16, prior to closing of the front opening/closing part 18, the main opening/closing part 26 is closed with respect to the image forming apparatus main body 16. An upper side surface of the main opening/closing part 26 is used as a discharge part to which a sheet on which an image is formed is discharged.

A sub opening/closing part 30 is attached to the main opening/closing part 26 openably/closably with respect to the main opening/closing part 26. The sub opening/closing part 30 can be opened/closed independently of the main opening/closing part 26, and the sub opening/closing part 30 can be opened with respect to the main opening/closing part 26 in a state where the main opening/closing part 26 is closed with respect to the image forming apparatus main body 16. The sub opening/closing part 30 is opened when the entire or part of a cleaning device 90 to be described later is attached/removed in/from the image forming apparatus main body 16.

The operation part 32 has ten keys to input e.g. the number of sheets used for image formation, a start key operated to start image formation, and the like.

An image forming part 40 to form an image on a sheet is provided in the image forming apparatus main body 16. The image forming part 40 has e.g. four photoreceptor units 200Y, 200M, 200C and 200K.

The photoreceptor units 200Y, 200M, 200C and 200K which are respectively used as an image forming structure have photoreceptor drums 210Y, 210M, 210C and 210K. The photoreceptor units 200Y, 200M, 200C and 200K are arrayed in this order sequentially from the rear side of the image forming apparatus main body 16 (right side in FIG. 2). The details of the photoreceptor units 200Y, 200M, 200C and 200K will be described later.

The photoreceptor drums 210Y, 210M, 210C and 210K are respectively used as an image holder.

Further, the image forming part 40 has an optical writing device 44 used as a latent image forming device. The optical writing device 44 emits light on the respective photoreceptor drums 210Y, 210M, 210C and 210K, and forms latent images on the respective surfaces of the photoreceptor drums 210Y, 210M, 210C and 210K.

Further, the image forming part 40 has developing devices 46Y, 46M, 46C and 46K. The developing device 46Y develops the latent image formed on the photoreceptor drum 210Y using yellow toner contained in the developing device 46Y. The developing device 46M develops the latent image formed on the photoreceptor drum 210M using magenta toner contained in the developing device 46M. The developing device 46C develops the latent image formed on the photoreceptor drum 210C using cyan toner contained in the developing device 46C. The developing device 46K develops the latent image formed on the photoreceptor drum 210K using black toner contained in the developing device 46K.

Further, the image forming part 40 has a transfer device 60. The transfer device 60 has the intermediate transfer belt 62 used as a transfer body. The intermediate transfer belt 62, which is an endless belt, is supported with support rollers 64, 66, 68, 70 and 72, rotatably in an arrow direction in FIG. 2. At least one of the support rollers 64, 66, 68, 70 and 72 is connected to a motor (not shown), and rotated by driving transmission from the motor, thereby transmits the driving to the intermediate transfer belt 62.

Further, the transfer device 60 has first transfer rollers 80Y, 80M, 80C and 80K used as first transfer devices. The first transfer roller 80Y transfers the yellow toner image, formed on the surface of the photoreceptor drum 210Y by the development of the latent image by the developing device 46Y, to the intermediate transfer belt 62. The first transfer roller 80M transfers the magenta toner image, formed on the surface of the photoreceptor drum 210M by the development of the latent image by the developing device 46M, to the intermediate transfer belt 62. The first transfer roller 80C transfers the cyan toner image formed on the surface of the photoreceptor drum 210C by the development of the latent image by the developing device 46C, to the intermediate transfer belt 62. The first transfer roller 80K transfers the black toner image formed on the surface of the photoreceptor drum 210K by the development of the latent image by the developing device 46K, to the intermediate transfer belt 62.

Further, the transfer device 60 has a second transfer roller 84 used as a second transfer device. The second transfer roller 84 transfers the yellow toner image, the magenta toner image, the cyan toner image and the black toner image transferred to the intermediate transfer belt 62 to a sheet.

Further, the transfer device 60 has the cleaning device 90. The cleaning device 90 has a scraping member 92 which, after the transfer of the respective color toner images to the sheet by the second transfer roller 84, scrapes off the respective color toner remaining on the surface of the intermediate transfer belt 62. The toner scraped off by the scraping member 92 is recovered inside the main body of the cleaning device 90. The cleaning device 90 is attachable/removable in/from the image forming apparatus main body 16 via an opening formed by opening the sub opening/closing part 30.

Among the constituent elements of the transfer device 60, the intermediate transfer belt 62, the support rollers 64, 66, 68, 70 and 72, the first transfer rollers 80Y, 80M, 80C and 80K, and the cleaning device 90 are attached to the main opening/closing part 26. In the transfer device 60, the second transfer roller 84 is attached to the image forming apparatus main body 16.

Further, a fixing device 50 to fix the toner image, transferred with the second transfer roller 84 to the sheet, to the sheet, is provided in the image forming apparatus main body 16.

Further, a recovery container 300 is provided in the image forming apparatus main body 16. Excessive developer discharged from the developing devices 46Y, 46M, 46C and 46K is recovered in the recovery container 300. The recovery container 300 is integrated with e.g. the photoreceptor unit 200K.

Further, a sheet supply device 110 to supply a sheet to the image forming part 40 is attached in the image forming apparatus main body 16. The sheet supply device 110 can be drawn to the front side of the image forming apparatus main body 16 (left side in FIG. 2). In a state where the sheet supply device 110 is drawn from the image forming apparatus main body 16, the sheets are replenished.

The sheet supply device 110 has a sheet container 112 containing the sheets such as normal paper in a stacked state. Further, the sheet supply device 110 has a conveyance roller 114 to extract a top sheet contained in the sheet container 112 and convey the extracted sheet toward the image forming part 40. Further, the sheet supply device 110 has a retard roller 116 to retard the sheets for prevention of a multi-feed state of plural overlapped sheets to the image forming part 40.

Further, a conveyance passage 130 used for sheet conveyance is formed in the image forming apparatus main body 16. The conveyance passage 130 has a main conveyance passage 132, a reverse conveyance passage 134, and a sub conveyance passage 136.

The main conveyance passage 132 is used for conveyance of the sheet supplied from the sheet supply device 110 to the image forming part 40, and discharge of a sheet on which an image is formed to the outside of the image forming apparatus main body 16. The above-described conveyance roller 114 and the retard roller 116, a registration roller 142, the above-described second transfer roller 84, the above-described fixing device 50, and a discharge roller 144, are provided along the main conveyance passage 132, sequentially from the upstream side in the direction where the sheet is conveyed.

The registration roller 142 temporarily stops the end of the sheet conveyed from the sheet supply device 110 side, and sends the sheet toward the second transfer roller, at the timing of transfer of respective color toner images to the intermediate transfer belt 62.

The discharge roller 144 discharges the sheet to which the respective color toner images are fixed by the fixing device 50 to the outside of the image forming apparatus main body 16.

The reverse conveyance passage 134 is used for supply of a sheet where a toner image is formed on one side again toward the image forming part 40 while reversing the sheet. For example, two reverse conveyance rollers 148 are provided along the reverse conveyance passage 134. A sheet is supplied from the rear end side to the reverse conveyance passage 134 by reverse rotation of the discharge roller 144 holding the rear end of the sheet, and the supplied sheet is conveyed to a position upstream of the registration roller 142 with the reverse conveyance rollers 148.

The sub conveyance passage 136 is used for supply of a sheet, different from the sheet contained in the sheet supply device 110, to the image forming part 40. The sheet is supplied to the sub conveyance passage 136 from the front side of the image forming apparatus main body 16 in a state where the supply opening/closing part 22 is opened. A conveyance roller 152 and a retard roller 154 are provided along the sub conveyance passage 136. The conveyance roller 152 conveys the sheet supplied to the sub conveyance passage 136 toward the image forming part 40. The retard roller 154 is used for retarding the sheet supplied to the sub conveyance passage 136 and for prevention of multi-feed of plural overlapped sheets to the image forming part 40.

Figure 3:
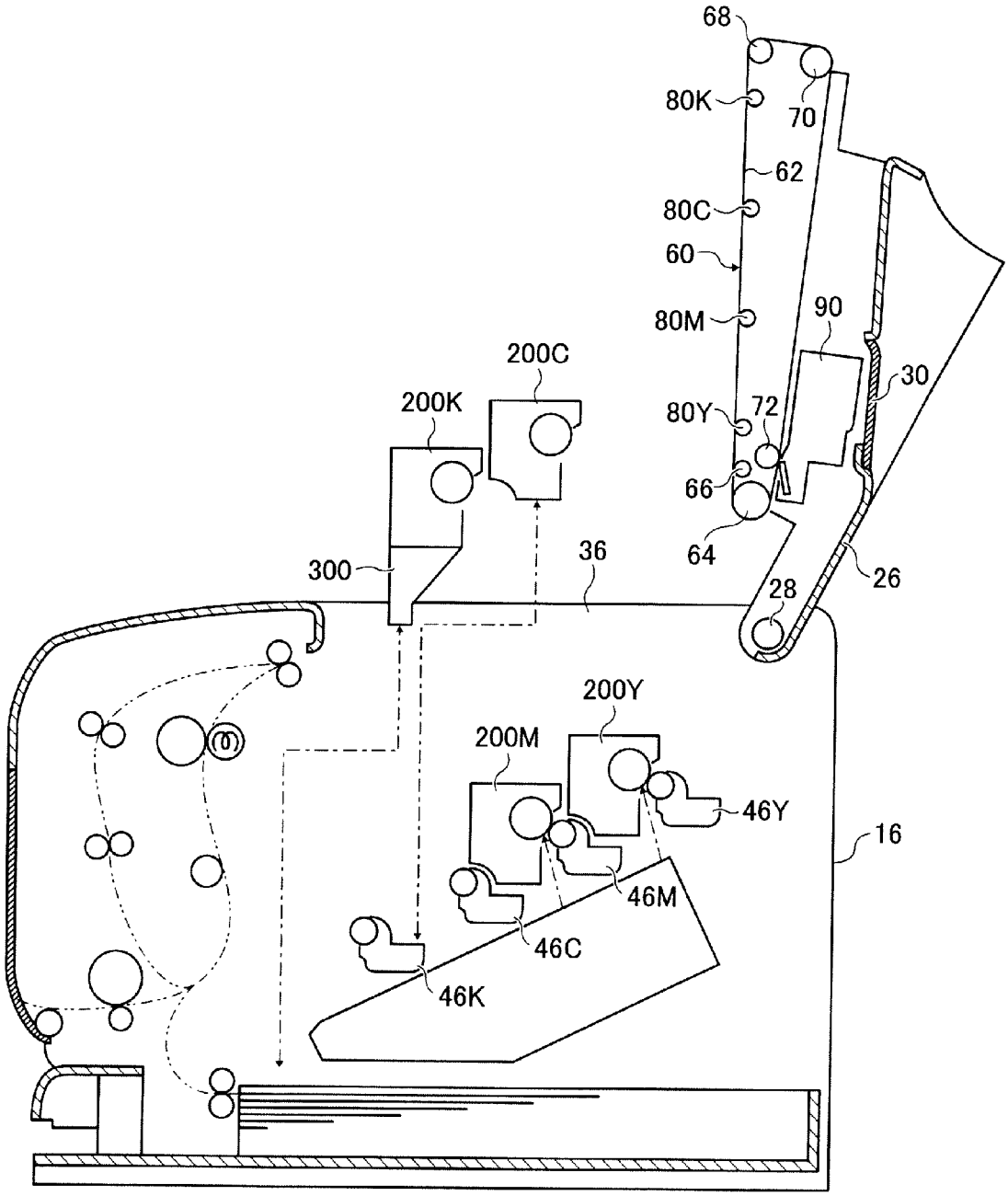
FIG. 3 is a cross-sectional diagram showing attachment/removal of an image forming structure in/from the image forming apparatus shown in FIG. 1.

FIG. 3 shows attachment/removal of the photoreceptor unit 200 in/from the image forming apparatus main body 16. As shown in FIG. 3, when the main opening/closing part 26 is opened with respect to the image forming apparatus main body 16, the intermediate transfer belt 62, the support rollers 64, 66, 68, 70 and 72, the first transfer rollers 80Y, 80M, 80C and 80K, and the cleaning device 90 of the transfer device 60 move along with the main opening/closing part 26, and an opening 36 is formed in the image forming apparatus main body 16. Then, the photoreceptor units 200Y, 200M, 200C and 200K are respectively attached/removed in/from the image forming apparatus main body 16 via the opening 36. The recovery container 300 is integrated with the photoreceptor unit 200K as described above. Accordingly, the recovery container 300 is attached/removed in/from the image forming apparatus main body 16, integrally with the photoreceptor unit 200K.

Figure 4:
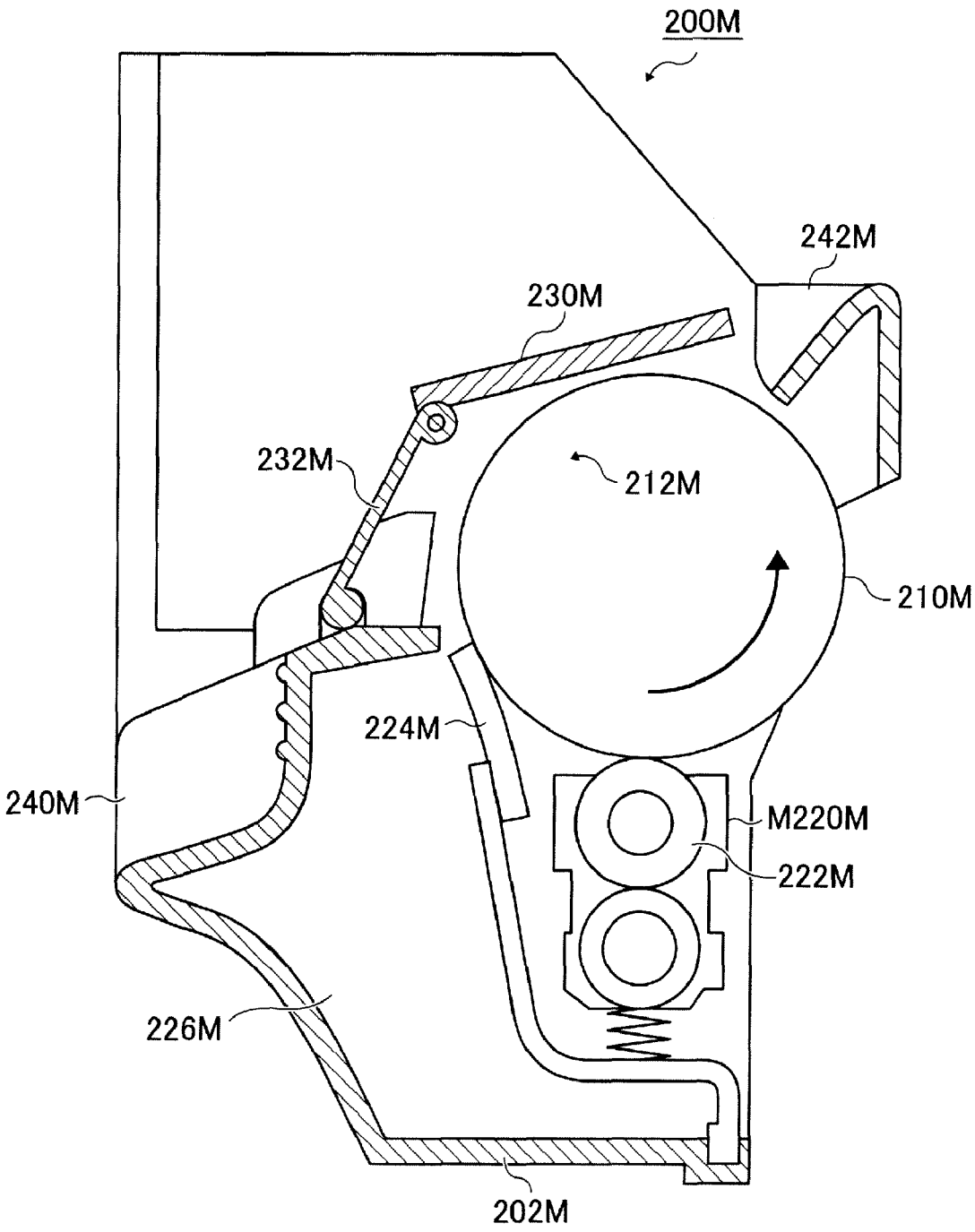
FIG. 4 is a cross-sectional diagram showing the image forming structure according to the exemplary embodiment of the present invention used in the image forming apparatus shown in FIG. 1.
Figure 5:
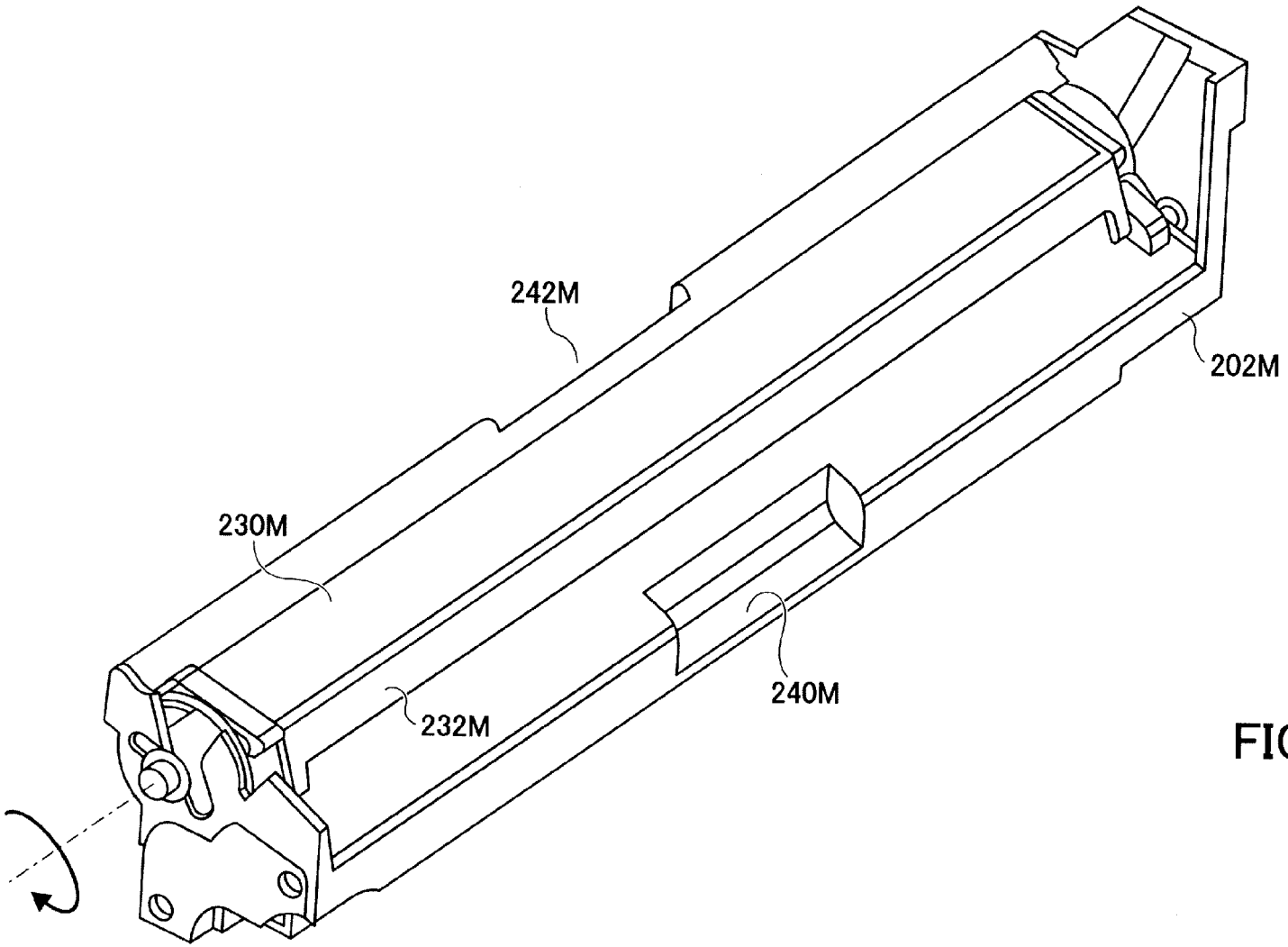
FIG. 5 is a perspective diagram showing the image forming structure shown in FIG. 4.

FIGS. 4 and 5 show the photoreceptor unit 200M. As shown in FIGS. 4 and 5, the photoreceptor unit 200M has a photoreceptor unit main body 202M, to which the above-described photoreceptor drum 210M is attached. A part of the photoreceptor drum 210M is exposed outside of the photoreceptor unit main body 202M as an exposed part 212M.

A charging device 220M to uniformly charge the surface of the photoreceptor drum 210M is attached in the photoreceptor unit main body 202M. The charging device 220M has a charging roller 222M in contact with the photoreceptor drum 210M. The optical writing device 44 (see FIG. 1) writes a latent image on the surface of the photoreceptor drum 210M uniformly charged by the charging device 220M.

Further, a scraping member 224M used as a cleaning device is attached in the photoreceptor unit main body 202M. When a magenta toner image has been transferred with the first transfer roller 80M (see FIG. 1) to the intermediate transfer belt 62, the scraping member 224M scrapes off the magenta toner remaining on the surface of the photoreceptor drum 210M.

Further, a recovery chamber 226M to recover the magenta toner scraped off by the scraping member 224M from the surface of the photoreceptor drum 210M is provided in the photoreceptor unit main body 202M.

Figure 6:
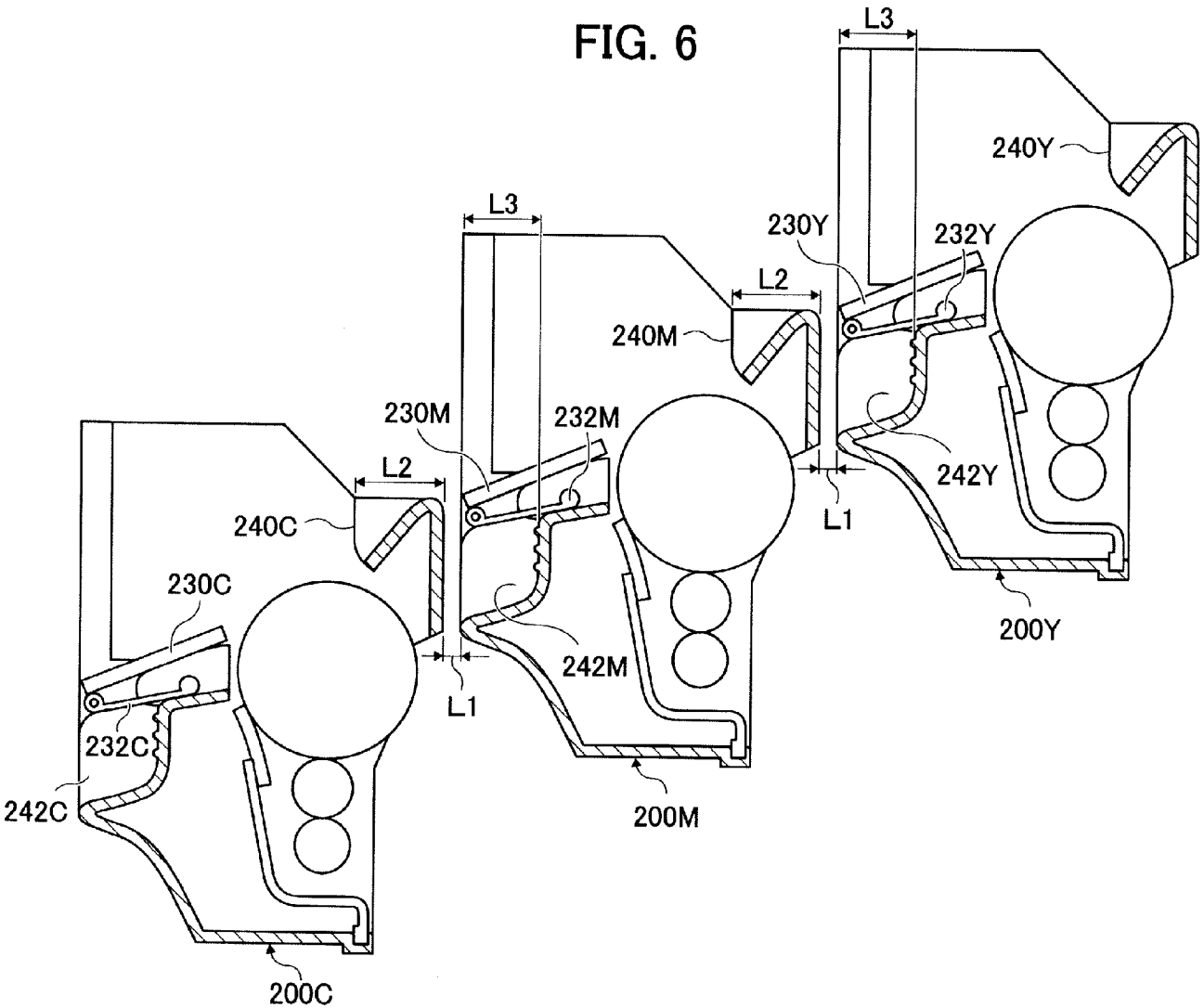
FIG. 6 is a cross-sectional diagram showing an arrangement of image forming structures shown in FIG. 4 attached in an image forming apparatus main body, viewed from a right side surface.

Further, a shutter 230M is attached via a support member 232M to the photoreceptor unit main body 202M. The support member 232M and the shutter 230M are used as an opening/closing part to open/close so as to move between a position to cover the exposed part 212M of the photoreceptor drum 210M (hereinbelow, a covering position) and a position to expose the exposed part 212M from the photoreceptor unit main body 202 (hereinbelow, an exposing position). FIG. 4 shows the shutter 230M and the support member 232M moved to the covering position. FIG. 6 shows the shutter 230M and the support member 232M moved to the exposing position.

When the shutter 230M and the support member 232M are in the exposing position, the shutter 230M and the support member 232M are arranged so as to cover the second concave part 242 from an upper position (see FIG. 6). Further, the shutter 230M and the support member 232M are in the exposing position, an upward surface of the shutter 230M is in approximately parallel with with the intermediate transfer belt 62.

In a state where the photoreceptor unit 200M is not attached in the image forming apparatus main body 16, the shutter 230M and the support member 232M are in the covering position. Further, when the photoreceptor unit 200M is attached in the image forming apparatus main body 16 and the main opening/closing part 26 is opened with respect to the mage forming apparatus main body 16, the shutter 230M and the support member 232M are in the covering position.

In a state where the photoreceptor unit 200M is attached in the image forming apparatus main body 16, when the main opening/closing part 26 is closed with respect to the image forming apparatus main body 16, in accordance with the closing of the main opening/closing part 26, the shutter 230M and the support member 232M move to the exposing position. Further, when the main opening/closing part 26 is opened with respect to the image forming apparatus main body 16, in accordance with the opening of the main opening/closing part 26, the shutter 230M and the support member 232M move to the covering position.

The linkage between the opening/closing of the main opening/closing part 26 and that of the shutter 230M and the support member 232M is realized with a link mechanism (not shown).

Further, in the photoreceptor unit 200M, a first concave part 240M and a second concave part 242M are formed in e.g. the photoreceptor unit main body 202M.

Note that although the photoreceptor units 200Y, 200C and 200K use different color toners, these photoreceptor units have the same structure as that of the photoreceptor unit 200M, accordingly, the explanations of these photoreceptor units will be omitted.

Figure 7:
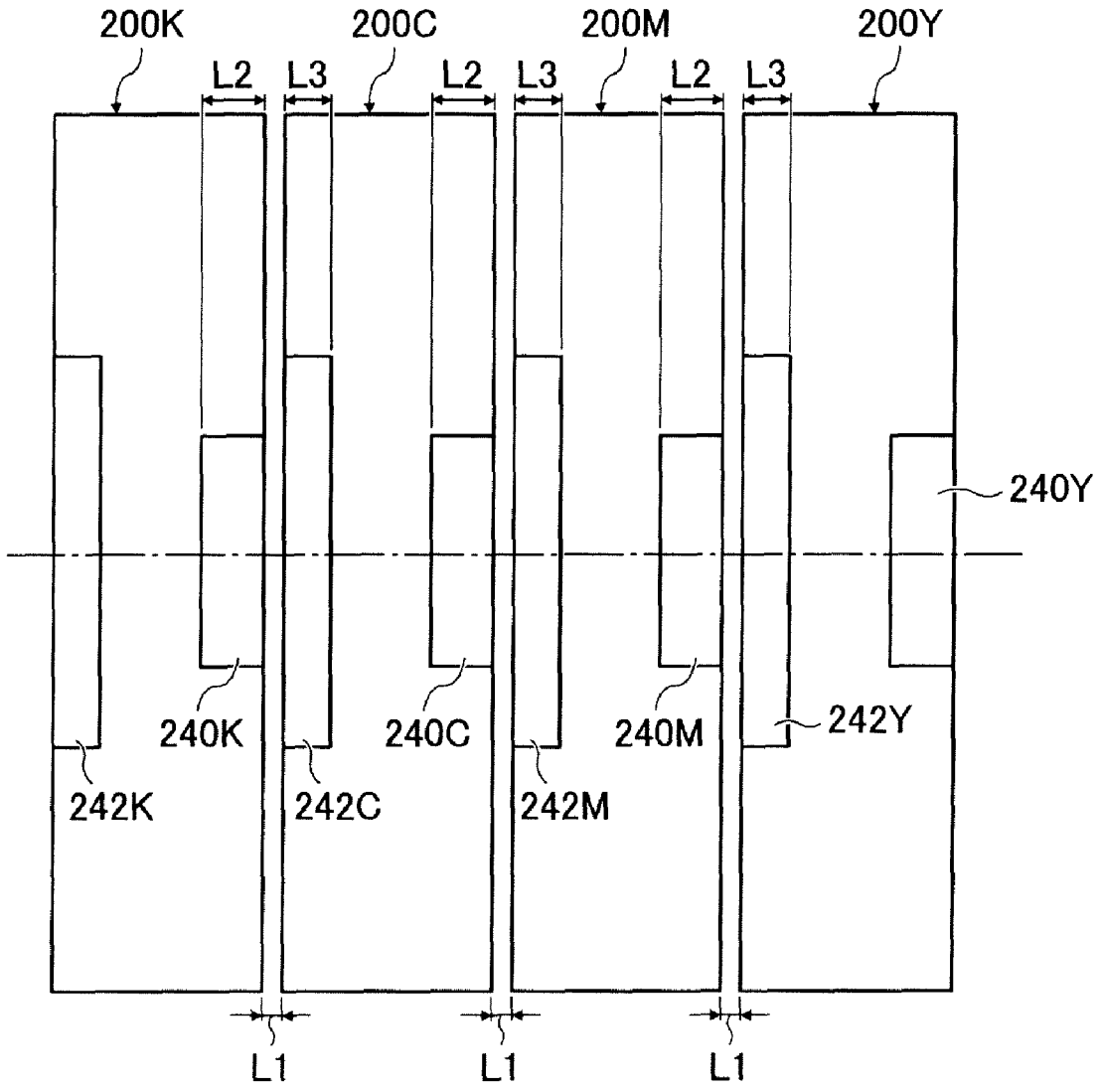
FIG. 7 is a plan view of the image forming structures shown in FIG. 4 attached in the image forming apparatus main body.

FIGS. 6 and 7 show an arrangement when the photoreceptor units 200 are attached in the image forming apparatus main body 16.

As shown in FIGS. 6 and 7, the first concave part 240M of the photoreceptor unit 200M is formed in a position opposite to the second concave part 242Y formed in the photoreceptor unit 200Y as an adjacent photoreceptor unit. Further, the second concave part 242M of the photoreceptor unit 200M is formed in a position opposite to the first concave part 240C formed in the photoreceptor unit 200C as another adjacent photoreceptor unit.

Further, it can also be considered that in the photoreceptor unit 200M, the first concave part 240M is formed so as to be opposite to the second concave part 242Y formed in the photoreceptor unit 200Y as another photoreceptor unit adjacent to one end side, and the second concave part 242M is formed so as to be opposite to the first concave part 240C formed in the photoreceptor unit 200C as another photoreceptor unit adjacent to the other end side.

Regarding the photoreceptor unit 200C, it can be considered that the first concave part 240C of the photoreceptor unit 200C is formed in a position opposite to the second concave part 242M formed in the photoreceptor unit 200M as an adjacent photoreceptor unit. Further, it can be considered that the second concave part 242C of the photoreceptor unit 200C is formed in a position opposite to the first concave part 240K formed in the photoreceptor unit 200K as another adjacent photoreceptor unit.

Further, it can also be considered that in the photoreceptor unit 200C, the first concave part 240C is formed so as to be opposite to the second concave part 242M formed in the photoreceptor unit 200M as another photoreceptor unit adjacent to one end side, and the second concave part 242C is formed so as to be opposite to the first concave part 240K formed in the photoreceptor unit 200K as another photoreceptor unit adjacent to the other end side.

Further, regarding the photoreceptor unit 200Y, it can be considered that the second concave part 242Y of the photoreceptor unit 200Y is formed in a position opposite to the first concave part 240M formed in the photoreceptor unit 200M as an adjacent photoreceptor unit.

Further, regarding the photoreceptor unit 200K, it can be considered that the first concave part 240K of the photoreceptor unit 200K is formed in a position opposite to the second concave part 242C formed in the photoreceptor unit 200C as an adjacent photoreceptor unit.

The first concave part 240Y and the second concave part 242Y of the photoreceptor unit 200Y are formed in an approximate central portion in a lengthwise direction of the photoreceptor unit 200Y. Further, the first concave part 240M and the second concave part 242M of the photoreceptor unit 200M are formed in an approximate central portion in the lengthwise direction of the photoreceptor unit 200M. Further, the first concave part 240C and the second concave part 242C of the photoreceptor unit 200C are formed in an approximate central portion in the lengthwise direction of the photoreceptor unit 200C. Further, the first concave part 240K and the second concave part 242K of the photoreceptor unit 200K are formed in an approximate central portion in the lengthwise direction of the photoreceptor unit 200K.

Further, assuming that a clearance between plural adjacent photoreceptor units 200 is L1, a depth of the first concave part formed in a position on the side of one of the adjacent photoreceptor units 200 is L2, and a depth of the second concave part formed in a position on the side of the other one of the adjacent photoreceptor units 200 is L3, the respective photoreceptor units 200 are arranged so as to satisfy the relation in the following expression (1).

$$L1<L2+L3 \quad (1)$$

Figure 8:
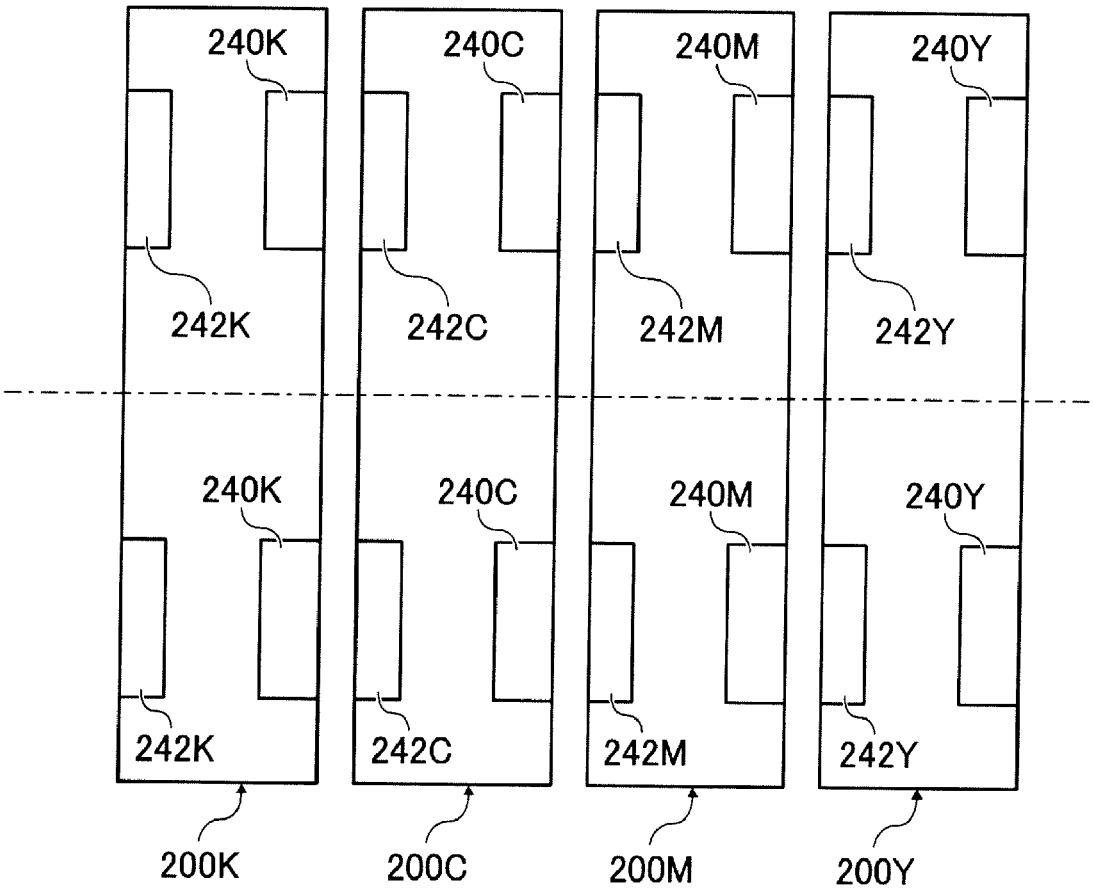
FIG. 8 is a plan view schematically showing an arrangement of the image forming structures according to a first modification attached in the image forming apparatus main body.

FIG. 8 shows the photoreceptor units 200Y, 200M, 200C and 200K according to a first modification of the present invention.

In the photoreceptor unit 200 according to the above-described exemplary embodiment, one first concave part 240 and one second concave part 242 are formed in the respective photoreceptor units 200. In the photoreceptor unit 200 according to the modification, two first concave parts 240 and two second concave parts 242 are formed in the respective photoreceptor units 200.

The two first concave parts 240 are formed in positions on both end sides in the lengthwise direction of the respective photoreceptor units 200. Further, the two second concave parts 242 are formed in positions on the both end sides in the lengthwise direction of the respective photoreceptor units 200.

Figure 9:
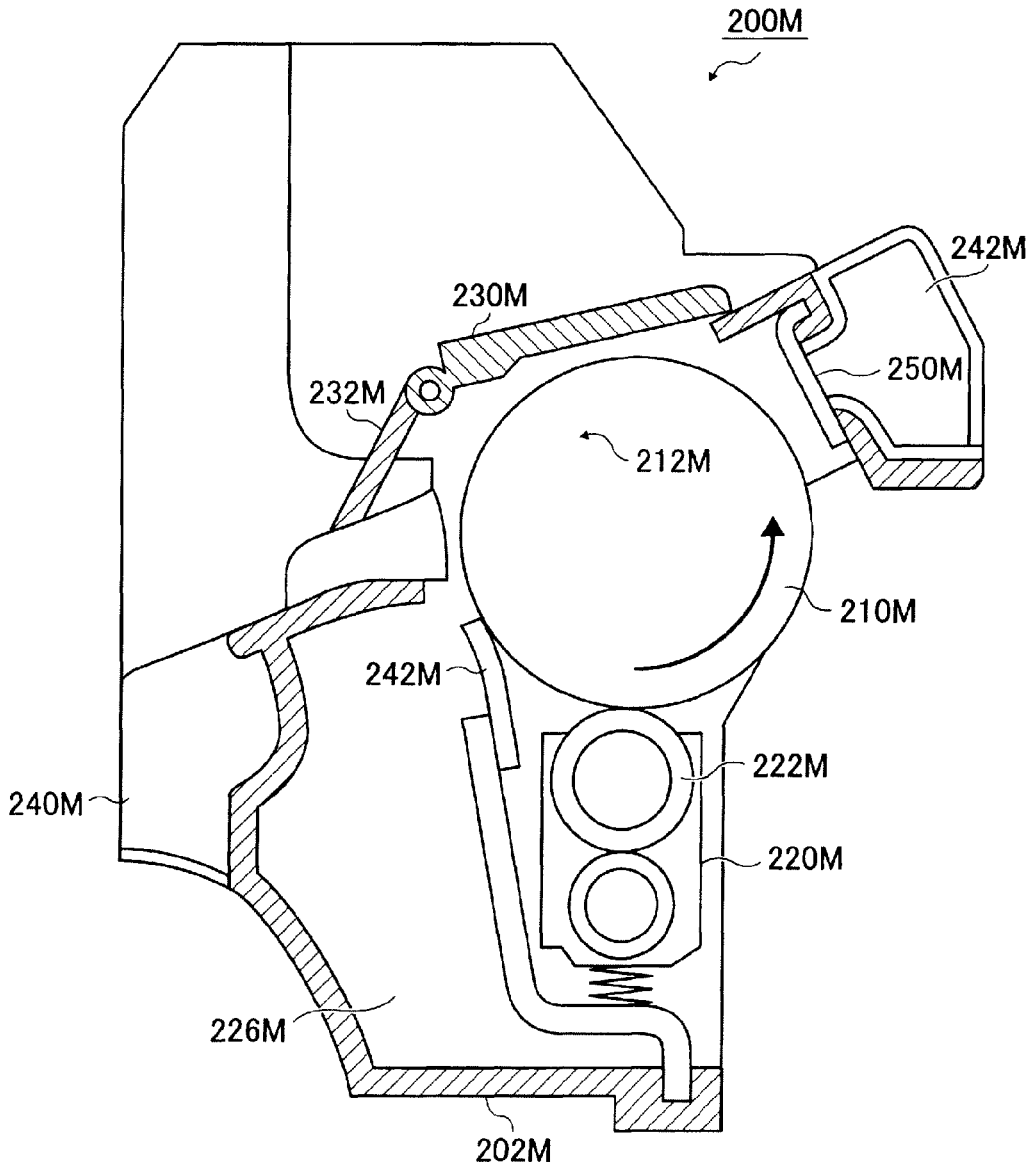
FIG. 9 is a cross-sectional diagram showing the image forming structure according to a second modification.

FIG. 9 shows the photoreceptor unit 200M according to a second modification of the present invention.

In the photoreceptor unit 200M according to the above-described exemplary embodiment, the second concave part 242M is formed so as to be surrounded with an outer wall of the photoreceptor unit main body 202M. The photoreceptor unit 200M according to the second modification has a sheet metal 250M attached to the photoreceptor unit main body 202M for reinforcement, and the second concave part 242M is formed so as to be surrounded with the sheet metal 250M and the photoreceptor unit main body 202.

Note that although the photoreceptor units 200Y, 200C and 200K according to the second modification use different color toners, these photoreceptor units have the same structure as that of the photoreceptor unit 200M according to the second modification, and therefore the explanations of these photoreceptor units will be omitted.

In the above description, the photoreceptor units 200Y, 200M, 200C and 200K have the same shape and the same structure; however, it may be arranged such that the photoreceptor units 200Y, 200M, 200C and 200K have different shapes and structures.

As described above, the present invention is applicable to an image forming apparatus such as a copier, a printer and a facsimile apparatus, and an image forming structure attached/removed in/from the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body; and an image forming structure attached to and removed from the image forming apparatus main body, in a state where the image forming structure is attached in the image forming apparatus main body, a first concave part being formed in a position opposite to a second concave part formed in an adjacent image forming structure, and wherein the plurality of image forming structures respectively have:

an image forming structure main body;

an image holder, having an exposed part that can be exposed from the image forming structure main body, attached in the image forming structure; and an opening and closing part that is opened and closed so as to be movable between a position to cover the exposed part of the image holder and a position to expose the exposed part from the image forming structure main body, and wherein the opening and closing part is arranged between the first concave part and the second concave part when the opening and closing part is at the position to cover the exposed part of the image holder.

2. The image forming apparatus according to claim 1, wherein the first concave part is formed in a central portion in a lengthwise direction of the image forming structure.

3. The image forming apparatus according to claim 1, wherein the first and second concave parts are formed in two positions on both end sides in a lengthwise direction of the image forming structure.

4. An image forming apparatus comprising:

an image forming apparatus main body; and a plurality of image forming structures attached to and removed from the image forming apparatus main body, in a state where the image forming structures are attached in the image forming apparatus main body, a first concave part of a first image forming structure being formed so as to be opposite to a second concave part of a second image forming structure adjacent to one end side of the first image forming structure, and a second concave part of the first image forming structure being formed so as to be opposite to a first concave part of a third image forming structure adjacent to another end side of the first image forming structure, and wherein the plurality of image forming structures respectively have:

an image forming structure main body;

an image holder, having an exposed part that can be exposed from the image forming structure main body, attached in the image forming structure; and an opening and closing part that is opened and closed so as to be movable between a position to cover the exposed part of the image holder and a position to expose the exposed part from the image forming structure main body, and wherein the opening and closing part is arranged between the first concave part of the first image forming structure and the second concave part of the second image forming structure when the opening and closing part is at the position to cover the exposed part of the image holder.

5. The image forming apparatus according to claim 4, wherein, assuming that a clearance between the plurality of adjacent image forming structures is L1, a depth of the first concave part is L2, and a depth of the second concave part is L3, L1<L2+L3 holds.

6. The image forming apparatus according to claim 4, wherein the first concave part and the second concave part are formed in a central portion in a lengthwise direction of the image forming structure.

7. The image forming apparatus according to claim 4, wherein the first concave part and the second concave part are formed respectively in two positions on both end sides in a lengthwise direction of the image forming structure.

8. An image forming structure, attached to and removed from an image forming apparatus main body, in a state where the image forming structure is attached in the image forming apparatus main body, a first concave part being formed in a position opposite to a second concave part formed in an adjacent image forming structure, and wherein the image forming structure includes:

an image forming structure main body;

an image holder, having an exposed part that can be exposed from the image forming structure main body, attached in the image forming structure; and an opening and closing part that is opened and closed so as to be movable between a position to cover the exposed part of the image holder and a position to expose the exposed part from the image forming structure main body, and wherein the opening and closing part is arranged between the first concave part and the second concave part when the opening and closing part is at the position to cover the exposed part of the image holder.

9. An image forming structure comprising a plurality of image forming units, attached to and removed from an image forming apparatus main body, in a state where the image forming units are attached in the image forming apparatus main body, a first concave part of a first image forming unit being formed so as to be opposite to a second concave part of a second image forming unit adjacent to one end side of the first image forming unit, and a second concave part of the first image forming unit being formed so as to be opposite to a first concave part of a third image, forming unit adjacent to another end side of the first image forming unit, and wherein the image forming structure includes:

an image forming structure main body;

an image holder, having an exposed part that can be exposed from the image forming structure main body, attached in the image forming structure; and an opening and closing part that is opened and closed so as to be movable between a position to cover the exposed part of the image holder and a position to expose the exposed part from the image forming structure main body, and wherein the opening and closing part is arranged between the first concave part and the second concave part when the opening and closing part is at the position to cover the exposed part of the image holder.

10. The image forming apparatus according to claim 1, wherein the opening and closing part is opened and closed in accordance with an opening and a closing of a main opening and closing part.

11. The image forming apparatus according to claim 1, wherein the opening and closing part covers the second concave part when the opening and closing part is at the position to expose the exposed part of the image holder.

* * * * *